US009151191B1

(12) United States Patent
David et al.

(10) Patent No.: US 9,151,191 B1
(45) Date of Patent: Oct. 6, 2015

(54) ELECTRICALLY ACTUATED CAMSHAFT PHASER

(71) Applicant: DELPHI TECHNOLOGIES, INC., Troy, MI (US)

(72) Inventors: Pascal David, Beidweiler (LU); Pierre Kimus, Attert (BE); Eric Bourniche, Preutin-Higny (FR)

(73) Assignee: Delphi Technologies, Inc., Troy, MI (US)

( * ) Notice: Subject to any disclaimer, the term of this patent is extended or adjusted under 35 U.S.C. 154(b) by 14 days.

(21) Appl. No.: 14/242,218

(22) Filed: Apr. 1, 2014

(51) Int. Cl.
*F01L 1/34* (2006.01)
*F01L 1/352* (2006.01)

(52) U.S. Cl.
CPC ..... *F01L 1/352* (2013.01); *F01L 2001/3521* (2013.01)

(58) Field of Classification Search
CPC ..... F01L 1/352; F01L 2001/3521
USPC ..... 123/90.15, 90.17
See application file for complete search history.

(56) References Cited

U.S. PATENT DOCUMENTS

| | | | | |
|---|---|---|---|---|
| 4,770,060 | A | 9/1988 | Elrod et al. | |
| 4,771,742 | A | 9/1988 | Nelson et al. | |
| 5,136,887 | A | 8/1992 | Elrod et al. | |
| 5,161,429 | A | 11/1992 | Elrod et al. | |
| 5,253,546 | A | 10/1993 | Elrod et al. | |
| 5,417,186 | A | 5/1995 | Elrod et al. | |
| 6,257,186 | B1 | 7/2001 | Heer | |
| 6,302,073 | B1 | 10/2001 | Heer | |
| 6,328,006 | B1 | 12/2001 | Heer | |
| 6,981,478 | B2 | 1/2006 | Schäfer et al. | |
| 7,421,990 | B2 | 9/2008 | Taye et al. | |
| 7,673,598 | B2 | 3/2010 | Schaefer et al. | |
| 8,322,318 | B2 | 12/2012 | David et al. | |
| 8,424,500 | B2 | 4/2013 | David et al. | |
| 8,516,983 | B2 | 8/2013 | David et al. | |
| 8,677,963 | B2 * | 3/2014 | Stoltz-Douchet et al. | 123/90.17 |
| 2010/0288216 | A1 | 11/2010 | Takahashi et al. | |
| 2011/0030631 | A1 | 2/2011 | David et al. | |
| 2011/0277713 | A1 | 11/2011 | David et al. | |
| 2011/0315102 | A1 | 12/2011 | David et al. | |
| 2012/0053817 | A1 | 3/2012 | Gauthier et al. | |
| 2012/0145104 | A1 | 6/2012 | David et al. | |
| 2012/0291729 | A1 | 11/2012 | David et al. | |
| 2012/0312258 | A1 | 12/2012 | Kimus et al. | |
| 2013/0008398 | A1 | 1/2013 | Stoltz-Douchet et al. | |
| 2013/0019825 | A1 | 1/2013 | Fischer | |

FOREIGN PATENT DOCUMENTS

| | | | |
|---|---|---|---|
| EP | 1813783 | B1 | 5/2008 |
| JP | H0267405 | A | 3/1990 |

* cited by examiner

*Primary Examiner* — Ching Chang
(74) *Attorney, Agent, or Firm* — Thomas N. Twomey

(57) ABSTRACT

A camshaft phaser includes a housing having a housing bore extending along an axis and a plurality of lobes extending radially inward. The camshaft phaser also includes a stroke limiter having a central hub with a plurality of vanes extending radially outward such that the vanes are interspersed with lobes. The camshaft phaser also includes a harmonic gear drive unit disposed operationally between the housing and the stroke limiter, the harmonic gear drive unit being connected to a rotational actuator for imparting rotation on the harmonic gear drive unit such that rotation of the harmonic gear drive unit by the rotational actuator causes relative rotation between the housing and the stroke limiter. The amount of relative rotation between the housing and the stroke limiter is limited by at least one of the plurality of lobes and at least one of the plurality of vanes.

23 Claims, 3 Drawing Sheets

20

ELECTRICALLY ACTUATED CAMSHAFT PHASER

TECHNICAL FIELD OF INVENTION

The present invention relates to a camshaft phaser which uses an electric motor to vary the phase relationship between a crankshaft and a camshaft of an internal combustion engine; more particularly, to such a camshaft phaser which comprises a harmonic gear drive unit; and still even more particularly to such a camshaft phaser having a housing with a plurality of inwardly extending lobes and a stroke limiter with a plurality of outwardly extending vanes such that the phase authority of the camshaft phaser is limited by the lobes and vanes.

BACKGROUND OF INVENTION

Camshaft phasers for varying the timing of combustion valves in internal combustion engines are well known. A first element, known generally as a sprocket element, is driven by a chain, belt, or gearing from the crankshaft of the internal combustion engine. A second element, known generally as a camshaft plate, is mounted to the end of a camshaft of the internal combustion engine. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, and consequently the angular position of the camshaft relative to the crankshaft, as required to meet current or anticipated engine operating conditions.

While vane-type camshaft phasers are effective and relatively inexpensive, they do suffer from drawbacks such as slow operation at low engine speeds due to low oil pressure, slow operation at low engine temperatures due to high oil viscosity, increased oil pump capacity requirement for the oil pump used to lubricate the internal combustion because the same pump is used to actuate the vane-type camshaft phaser, and the total amount of phase authority provided by vane-type camshaft phasers is limited by the amount of space between adjacent vanes and lobes and may not be sufficient to provide the desired amount of phase authority. For at least these reasons, the automotive industry is developing electrically driven camshaft phasers.

One type of electrically driven camshaft phaser being developed uses a harmonic gear drive unit, actuated by an electric motor, to change the angular position of the camshaft relative to the crankshaft. One example of such a camshaft phaser is shown in U.S. Pat. No. 8,322,318 to David et al., the disclosure of which is incorporated herein by reference in its entirety. The camshaft phaser of David et al. includes stop members which limit the phase authority of the camshaft phaser, i.e. the extent to which the camshaft phaser is able to advance and retard the camshaft relative to the crankshaft. While the camshaft phaser of David et al. may be effective, other options may be desirable to offer design flexibility and meet requirements in different vehicle applications.

What is needed is an electrically driven camshaft phaser which minimizes or eliminates one of more of the shortcomings as set forth above.

SUMMARY OF THE INVENTION

Briefly described, a camshaft phaser is provided for controllably varying the phase relationship between a crankshaft and a camshaft of an internal combustion engine. The camshaft phaser includes a housing connectable to the crankshaft and having a housing bore extending along an axis and a plurality of lobes extending radially inward such that a space is formed between adjacent ones of the plurality of lobes. The camshaft phaser also includes a stroke limiter connectable to the camshaft and disposed coaxially within the housing, the stroke limiter having a central hub with a plurality of vanes extending radially outward therefrom such that each one of the plurality of vanes extends into a respective space formed between adjacent ones of the plurality of lobes. The camshaft phaser also includes a harmonic gear drive unit disposed operationally between the housing and the stroke limiter, the harmonic gear drive unit being connected to a rotational actuator for imparting rotation on the harmonic gear drive unit such that rotation of the harmonic gear drive unit by the rotational actuator causes relative rotation between the housing and the stroke limiter. The amount of relative rotation between the housing and the stroke limiter is limited by at least one of the plurality of lobes and at least one of the plurality of vanes.

BRIEF DESCRIPTION OF DRAWINGS

This invention will be further described with reference to the accompanying drawings in which.

DETAILED DESCRIPTION OF INVENTION

Figure 1:
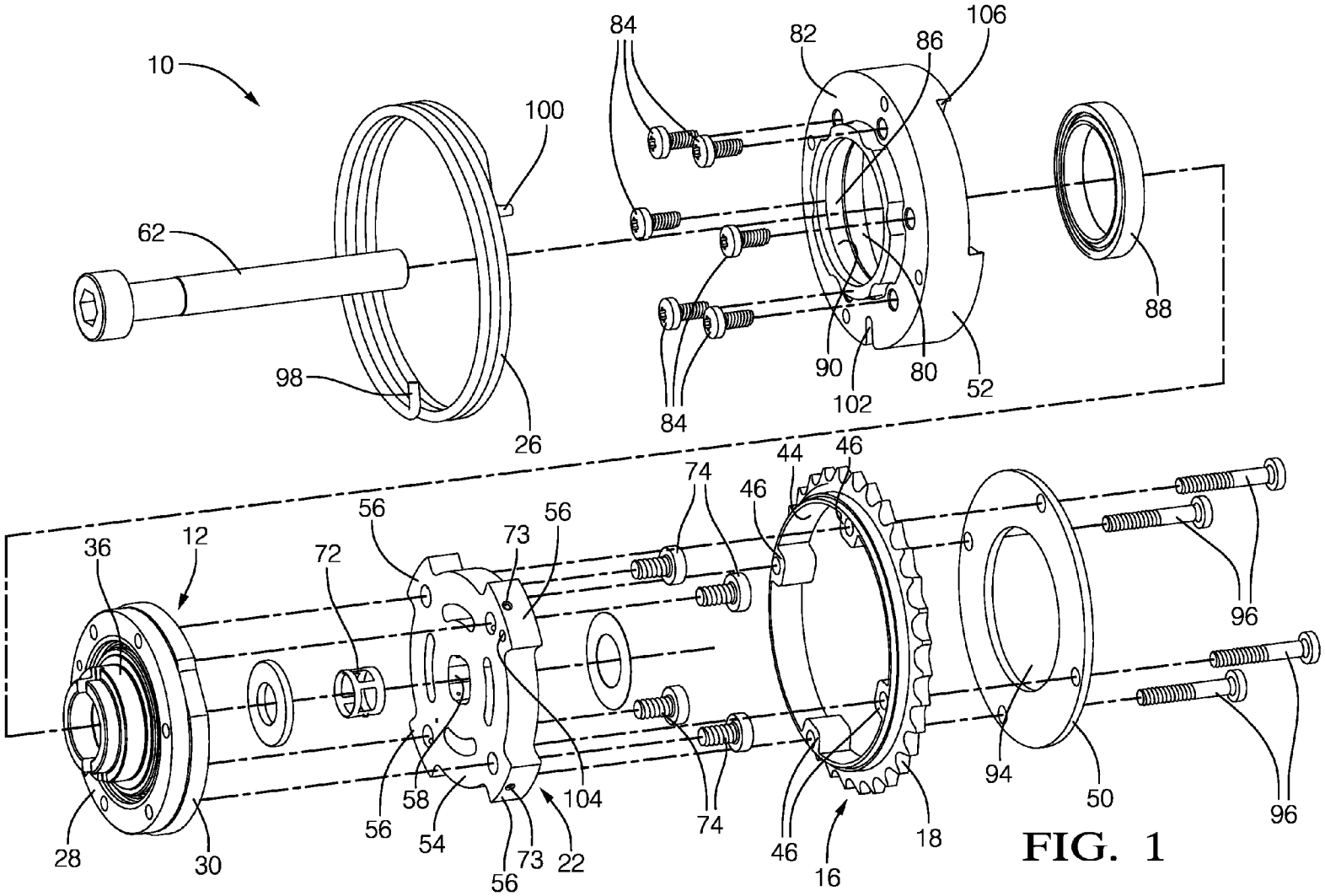
FIG. 1 is an exploded isometric view of a camshaft phaser in accordance with the present invention.
Figure 2:
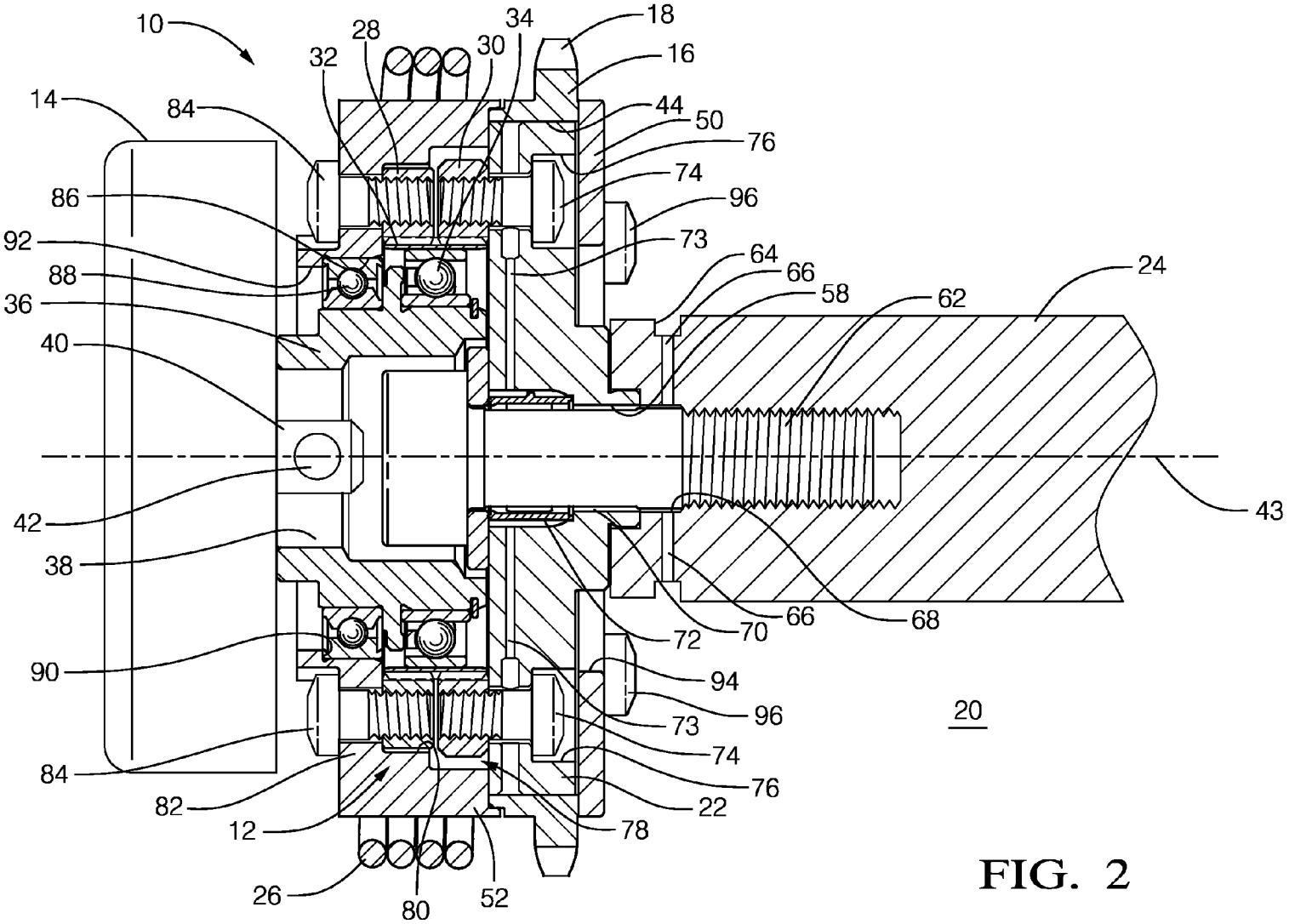
FIG. 2 is an axial cross-sectional view of the camshaft phaser in accordance with the present invention.
Figure 3:
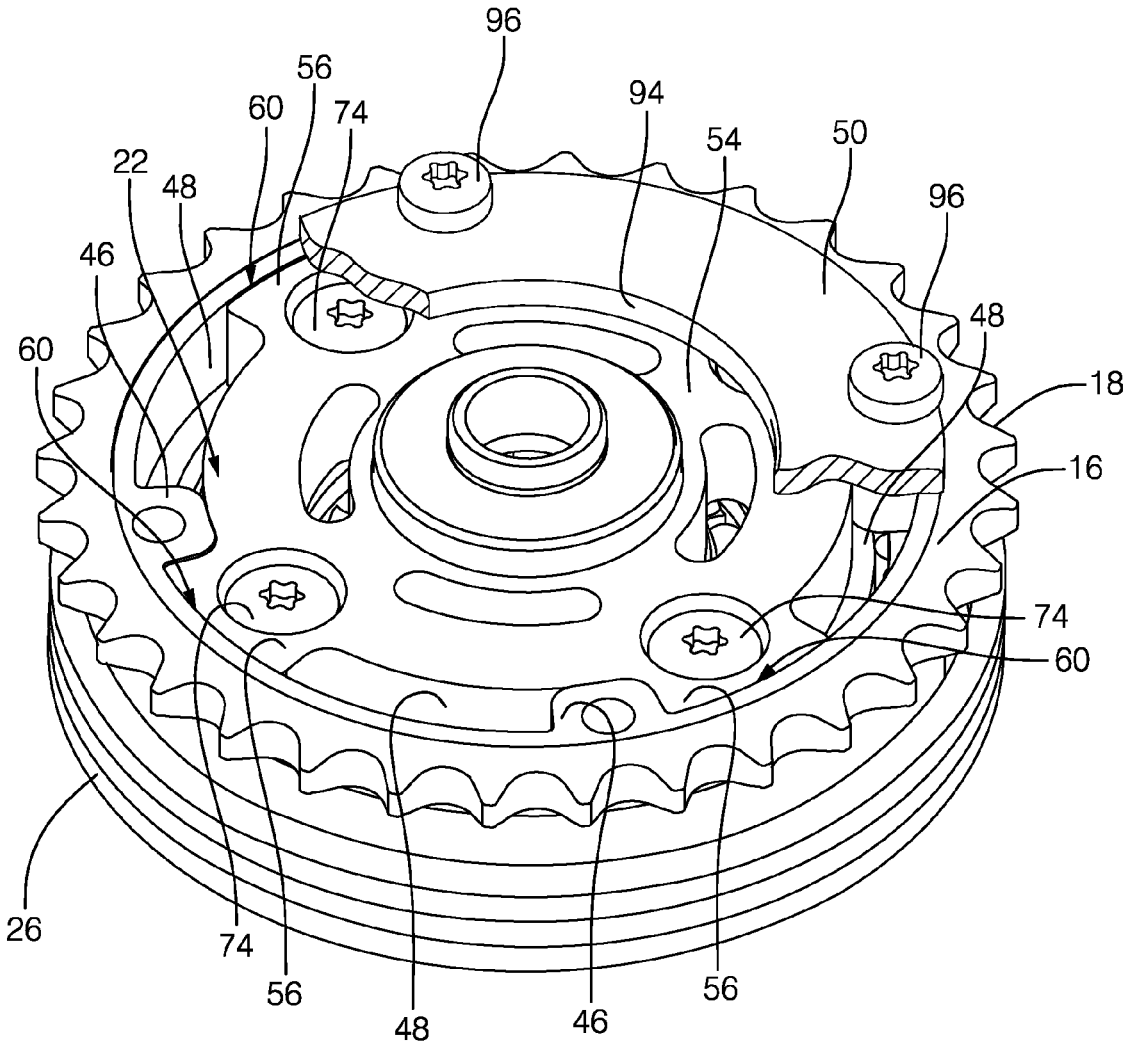
FIG. 3 is an isometric rear view of the camshaft phaser in accordance with the present invention with a back cover of the camshaft phaser partially cut away.

Referring to FIGS. 1-3, a camshaft phaser 10 in accordance with the present invention comprises a gear drive unit illustrated as harmonic gear drive unit 12; a rotational actuator illustrated as electric motor 14 which is operationally connected to harmonic gear drive unit 12 and which may be a DC electric motor; a housing 16 with an input sprocket 18 operationally connected to harmonic gear drive unit 12 and drivable by a crankshaft (not shown) of an internal combustion engine 20; a stroke limiter 22 operationally connected to harmonic gear drive unit 12 and mountable to an end of a camshaft 24 of internal combustion engine 20; and a bias spring 26 operationally disposed between stroke limiter 22 and input sprocket 18. It should now be understood that sprocket 18, which is driven by the crankshaft through a chain (not shown) could be substituted with a pulley to be driven, for example, by a toothed belt or other drive arrangement.

Harmonic gear drive unit 12 comprises an outer first spline 28 which may be either a circular spline or a dynamic spline as described below; an outer second spline 30 which is the opposite (dynamic or circular) of outer first spline 28 and is coaxially positioned adjacent outer first spline 28; a flexspline 32 disposed radially inward of both outer first spline 28 and outer second spline 30 and having outwardly-extending gear teeth disposed for engaging inwardly-extending gear teeth on both outer first spline 28 and outer second spline 30; and a wave generator 34 disposed radially inwards of and engaging flexspline 32.

Flexspline 32 is a non-rigid ring with external teeth on a slightly smaller pitch diameter than the circular spline. Flexspline 32 is fitted over and elastically deflected by wave generator 34.

The circular spline (either outer first spline 28 or outer second spline 30) is a rigid ring with internal teeth engaging the teeth of flexspline 32 across the major axis of wave generator 34. The circular spline may serve as the input member.

The dynamic spline (whichever of outer first spline 28 and outer second spline 30 that is not the circular spline) is a rigid ring having internal teeth of the same number as flexspline 32. The dynamic spline rotates together with flexspline 32 and may serve as the output member. Either the dynamic spline or the circular spline may be identified by a chamfered corner at its outside diameter to distinguish the circular spline from the dynamic spline.

Wave generator 34 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of harmonic gear drive unit 12, the outwardly extending teeth of flexspline 32 engage the inwardly extending teeth of the circular spline and the dynamic spline along and near the major elliptical axis of wave generator 34. The dynamic spline has the same number of teeth as flexspline 32, so rotation of wave generator 34 causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator 34). Harmonic gear drive unit 12 is thus a high-ratio gear transmission; that is, the angular phase relationship between outer first spline 28 and outer second spline 30 changes by 2% for every revolution of wave generator 34.

Of course, as will be obvious to those skilled in the art, the circular spline rather may have slightly more teeth than the dynamic spline has, in which case the rotational relationships described below are reversed. Further features of harmonic gear drive unit 12 are described in U.S. Pat. No. 8,516,983 to David et al., the disclosure of which is incorporated herein by reference in its entirety.

Wave generator 34 includes a coupling adaptor 36 that is mounted thereto or formed integrally therewith. A coupling 38 is mounted to a motor shaft 40 of electric motor 14 and pinned thereto by a pin 42. Coupling 38 engages coupling adaptor 36, permitting wave generator 34 to be rotationally driven by electric motor 14, as may be desired to alter the phase relationship between outer first spline 28 and outer second spline 30. Further features of coupling adaptor 36 and coupling 38 are disclosed in United States Patent Application Publication No. US 2012/0291729 to David et al., the disclosure of which is incorporated herein by reference in its entirety.

Still referring to FIGS. 1-3, housing 16, which acts as in input member to camshaft phaser 10, is centered about an axis 43 about which camshaft 24 rotates. Housing 16 includes a housing bore 44 extending axially therethrough within which stroke limiter 22 is coaxially located. A plurality of lobes 46 extend radially inward such that spaces 48 are formed between circumferentially adjacent lobes 46. Housing 16 may preferably be made, for example only, by powder metal process which substantially net forms housing 16, thereby minimizing or eliminating the need to for subsequent machining operations. In the embodiment shown, there are four lobes 46 defining four spaces 48, however, it is to be understood that a different number of lobes 46 may be provided to define spaces 48 equal in quantity to the number of lobes 46. A back cover 50 is attached to an axial end of housing 16 that is proximal to camshaft 24 while a front cover 52 is fixed to the axial end of housing 16 that is opposite back cover 50. Back cover 50 and front cover 52 will be described in greater detail later.

Stroke limiter 22, which acts as an output member for camshaft phaser 10, includes a central hub 54 with a plurality of vanes 56 extending radially outward therefrom and a central through bore 58 extending axially therethrough. The number of vanes 56 is equal to the number of lobes 46 provided in housing 16. Stroke limiter 22 is disposed coaxially within housing 16 such that each vane 56 extends into a respective space 48. The radial tips of each vane 56 mate with a respective portion of housing bore 44 that is between lobes 46, and as a result, journal bearing interfaces 60 are formed between the radial tips of lobes 46 and housing 16 which substantially prevent tipping and radial movement of stroke limiter 22 within housing 16 while allowing stroke limiter 22 to rotate within housing 16 about axis 43. It should be noted that only three journal bearing interfaces 60 are visible in FIG. 3 because one is obscured by the portion of back cover 50 that has not been cut away. Stroke limiter 22 is allowed to rotate within housing 16 as determined by the size of spaces 48 and by the size of vanes 56. Consequently, the limits of phase change, i.e. phase authority, between camshaft 24 and the crankshaft of internal combustion engine 20 can be established by appropriately sizing lobes 46 of housing 16 and by appropriately sizing vanes 56 of stroke limiter 22. It should be noted that not all vanes 56 and lobes 46 need to necessarily contribute to limiting the phase authority, for example only, a single vane 56 could be used to limit the phase authority using adjacent lobes 46. Stroke limiter 22 is attached to camshaft 24 by a camshaft phaser attachment bolt 62 which extends through central through bore 58 and threadably engages camshaft 24. In this way, stroke limiter 22 is clamped securely to camshaft 24 and relative rotation between stroke limiter 22 and camshaft 24 is prevented.

In order to ensure smooth operation and provide resistance to wear, journal bearing interfaces 60 may be supplied with oil, for example, from internal combustion engine 20. Oil under pressure may be supplied via an oil gallery (not shown of internal combustion engine 20 to a camshaft annular oil groove 64 of camshaft 24. The oil is then communicated through radial camshaft oil passages 66 to a camshaft counter bore 68 which extends coaxially into camshaft 24. From camshaft counter bore 68, the oil is communicated to an annular space 70 formed radially between camshaft phaser attachment bolt 62 and central through bore 58 of stroke limiter 22. From annular space 70, the oil is passed through a filter 72 located within central through bore 58 of stroke limiter 22 and is communicated to the radial tip of each vane 56 through stroke limiter oil passages 73 that extend radially outward to the radial tip of each vane 56 from central through bore 58.

Outer second spline 30 is secured coaxially to stroke limiter 22 with bolts 74. Stroke limiter 22 includes bolt recesses 76 on the side thereof which faces toward back cover 50 in order to accommodate bolt heads of bolts 74. Bolts 74 extend through stroke limiter 22 and threadably engage outer second spline 30, thereby securely clamping stroke limiter 22 to outer second spline 30 and thereby preventing relative rotation between outer second spline 30 and stroke limiter 22. In this way, stroke limiter 22 rotates with outer second spline 30 in a one-to-one relationship. Alternatively, bolts 74 may extend through outer second spline 30 and threadably engage stroke limiter 22.

Front cover 52 is substantially cup-shaped and includes a front cover bore 78 which is stepped and extends axially thereinto about axis 43 from the end of front cover 52 that mates with housing 16. Front cover bore 78 includes a harmonic gear drive compartment 80 with harmonic gear drive unit 12 disposed coaxially therewithin. Harmonic gear drive compartment 80 terminates in a front cover end wall 82 which is annular in shape. Outer first spline 28 is secured to front cover end wall 82 by bolts 84 which pass through front cover end wall 82 and threadably engage outer first spline 28. Alternatively, bolts 84 may extend through outer first spline 28 and threadably engage front cover 52. Front cover bore 78 also includes a bearing compartment 86 defined in part radially inward of front cover end wall 82. Bearing compartment 86 receives a bearing 88 coaxially therewithin such that bearing 88 is fixed within bearing compartment 86, for example, by press fit. Bearing 88 radially supports coupling adaptor 36/wave generator 34 and allows coupling adaptor 36/wave generator 34 to rotate relative to front cover 52 in use. Bearing 88 may be axially indexed by a front cover shoulder 90 in bearing compartment 86. The end of front cover 52 that is distal from housing 16 includes a front cover through bore 92 extending coaxially therethrough in order to allow coupling adaptor 36 to extend therethrough.

Back cover 50 is substantially annular in shape and centered about axis 43, thereby defining a back cover through bore 94 coaxially therethrough. Back cover through bore 94 allows a portion of stroke limiter 22 to pass therethrough, thereby allowing stroke limiter 22 to engage camshaft 24. Back cover 50, housing 16, and front cover 52 are fixed to each other by bolts 96 which extend through back cover 50 and lobes 46 of housing 16 and threadably engage front cover 52. In this way, bolts 96 clamp back cover 50, housing 16, and front cover 52 securely together, thereby preventing relative rotation between back cover 50, housing 16, and front cover 52. Alternatively, bolts 96 may extend through front cover 52 and lobes 46 of housing 16 and threadably engage back cover 50.

Bias spring 26 may be positioned to radially surround front cover 52 and includes a bias spring front cover tang 98 at one end of bias spring 26 and a bias spring stroke limiter tang 100 at the other end of bias spring 26. Bias spring front cover tang 98 is attached to front cover 52, for example, by bias spring front cover tang 98 extending radially inward from bias spring 26 and being received within a notch 102 formed in the exterior surface of front cover 52. Bias spring stroke limiter tang 100 is attached to one of vanes 56 of stroke limiter 22, for example, by being formed to extend radially inward from bias spring 26 and being received within a bias spring anchor hole 104 formed axially in one of vanes 56. Bias spring stroke limiter tang 100 passes through front cover 52 via a front cover bias spring opening 106 formed radially through front cover 52. Front cover bias spring opening 106 is sufficiently large as to allow stroke limiter 22 to rotate relative to housing 16 to the extent allowed by vanes 56 and lobes 46 without bias spring stroke limiter tang 100 interfering with front cover 52. In the event of a malfunction of electric motor 14, bias spring 26 is biased to back-drive harmonic gear drive unit 12 without help from electric motor 14 to a predetermined rotational position of outer second spline 30. The predetermined position may be a position which allows internal combustion engine 20 to start or run, and the predetermined position may be at one of the extreme ends of the range of authority or intermediate of the phaser's extreme ends of its rotational range of authority. For example, the rotational range of travel in which bias spring 26 biases harmonic gear drive unit 12 may be limited to something short of the end stop position of the phaser's range of authority. Such an arrangement would be useful for internal combustion engines requiring an intermediate park position for idle or restart.

In operation, when a change of phase is desired between the crankshaft of internal combustion engine 20 and camshaft 24, motor shaft 40 of electric motor 14 is rotated by applying an electric current to electric motor 14. It should be noted that motor shaft 40 may be rotated either clockwise or counterclockwise as determined by whether it is desired to advance or retard camshaft 24 relative to the crankshaft. Rotation of motor shaft 40 causes wave generator 34 to rotate which causes a rotational wave to be generated in flexspline 32, thereby causing outer first spline 28 to rotate relative to outer second spline 30. Since outer first spline 28 is fixed to housing 16 and outer second spline 30 is fixed to stroke limiter 22, stroke limiter 22 also rotates relative to housing 16, thereby changing the phase relationship between camshaft 24 and the crankshaft to the extent allowed by vanes 56 of stroke limiter 22 and lobes 46 of housing 16.

While the gear drive unit of camshaft phaser 10 has been described herein as harmonic gear drive unit 12, it should now be understood that the invention encompasses camshaft phasers using any known gear drive units. Other gear drive units that may be used within the scope of this invention include, by non-limiting example, spur gear units, helical gear units, worm gear units, hypoid gear units, planetary gear units, and bevel gear units.

While this invention has been described in terms of preferred embodiments thereof, it is not intended to be so limited, but rather only to the extent set forth in the claims that follow.

We claim:

1. A camshaft phaser for controllably varying the phase relationship between a crankshaft and a camshaft in an internal combustion engine, said camshaft phaser comprising:

a housing connectable to said crankshaft and having a housing bore extending along an axis and a plurality of lobes extending radially inward such that a space is formed between adjacent ones of said plurality of lobes;

a stroke limiter connectable to said camshaft and disposed coaxially within said housing, said stroke limiter having a central hub with a plurality of vanes extending radially outward therefrom such that each one of said plurality of vanes extends into a respective said space formed between adjacent ones of said plurality of lobes; and a harmonic gear drive unit disposed operationally between said housing and said stroke limiter, said harmonic gear drive unit being connected to a rotational actuator for imparting rotation on said harmonic gear drive unit such that rotation of said harmonic gear drive unit by said rotational actuator causes relative rotation between said housing and said stroke limiter;

whereby the amount of relative rotation between said housing and said stroke limiter is limited by at least one of said plurality of lobes and at least one of said plurality of vanes.

2. A camshaft phaser as in claim 1 wherein said plurality of vanes of said stroke limiter form journal bearing interfaces with said housing bore, whereby said journal bearing interfaces substantially prevent radial movement and tipping of said stroke limiter within said housing.

3. A camshaft phaser as in claim 2 wherein at least one of said plurality of vanes includes an oil passage for communicating oil to at least one of said journal bearing interfaces.

4. A camshaft phaser as in claim 1 further comprising:

a back cover attached to one axial end of said housing; and a front cover attached to the other axial end of said housing.

5. A camshaft phaser as in claim 4 wherein said housing is clamped between said back cover and said front cover, thereby preventing relative rotation between said housing, said back cover, and said front cover.

6. A camshaft phaser as in claim 5 wherein said housing is clamped between said back cover and said front cover with a plurality of bolts which threadably engage one of said back cover and said front cover such that each one of said plurality of bolts extends through a respective one of said plurality of lobes of said housing.

7. A camshaft phaser as in claim 4 wherein said harmonic gear drive unit is disposed within a front cover bore of said front cover.

8. A camshaft phaser as in claim 4 wherein said harmonic gear drive unit comprises:

an outer first spline;

an outer second spline which is axially adjacent to said outer first spline;

a flexspline disposed radially within said outer first spline and said outer second spline; and a wave generator disposed radially within said flexspline, and a rotational actuator connectable to said wave generator such that rotation of said rotational actuator causes relative rotation between said outer first spline and said outer second spline.

9. A camshaft phaser as in claim 8 wherein said outer first spline is secured to said front cover to prevent relative rotation between said front cover and said outer first spline.

10. A camshaft phaser as in claim 9 wherein said outer second spline is secured to said stroke limiter to prevent relative rotation between said stroke limiter and said outer second spline.

11. A camshaft phaser as in claim 10 wherein a plurality of bolts are used to secure said outer second spline to said stroke limiter by threadably engaging said stroke limiter, said stroke limiter having a plurality of bolt recesses to accommodate bolt heads of said plurality of bolts.

12. A camshaft phaser as in claim 8 wherein said harmonic gear drive unit is disposed within a front cover bore of said front cover and wherein said front cover bore comprises a harmonic gear drive compartment for receiving said harmonic gear drive unit therein and a bearing compartment for receiving a bearing therein which supports said wave generator.

13. A camshaft phaser as in claim 8 further comprising a bias spring radially surrounding said front cover for rotationally biasing said outer second spline relative to said outer first spline.

14. A camshaft phaser as in claim 13 wherein said bias spring comprises a bias spring front cover tang at one end thereof which is attached to said front cover.

15. A camshaft phaser as in claim 13 wherein said bias spring comprises a bias spring stroke limiter tang which is attached to said stroke limiter.

16. A camshaft phaser as in claim 15 wherein said front cover includes a front cover bias spring opening extending radially therethrough such that said bias spring stroke limiter tang passes through said front cover bias spring opening.

17. A camshaft phaser for controllably varying the phase relationship between a crankshaft and a camshaft in an internal combustion engine, said camshaft phaser comprising:

a housing connectable to said crankshaft and having a housing bore extending along an axis and a plurality of lobes extending radially inward such that a space is formed between adjacent ones of said plurality of lobes;

a stroke limiter connectable to said camshaft and disposed coaxially within said housing, said stroke limiter having a central hub with a plurality of vanes extending radially outward therefrom such that each one of said plurality of vanes extends into a respective said space formed between adjacent ones of said plurality of lobes; and a gear drive unit disposed operationally between said housing and said stroke limiter, said gear drive unit being connected to a rotational actuator for imparting rotation on said gear drive unit such that rotation of said gear drive unit by said rotational actuator causes relative rotation between said housing and said stroke limiter;

whereby the amount of relative rotation between said housing and said stroke limiter is limited by at least one of said plurality of lobes and at least one of said plurality of vanes.

18. A camshaft phaser as in claim 17 wherein said plurality of vanes of said stroke limiter form journal bearing interfaces with said housing bore, whereby said journal bearing interfaces substantially prevent radial movement and tipping of said stroke limiter within said housing.

19. A camshaft phaser as in claim 18 wherein at least one of said plurality of vanes includes an oil passage for communicating oil to at least one of said journal bearing interfaces.

20. A camshaft phaser as in claim 17 further comprising:

a back cover attached to one axial end of said housing; and a front cover attached to the other axial end of said housing.

21. A camshaft phaser as in claim 20 wherein said housing is clamped between said back cover and said front cover, thereby preventing relative rotation between said housing, said back cover, and said front cover.

22. A camshaft phaser as in claim 21 wherein said housing is clamped between said back cover and said front cover with a plurality of bolts which threadably engage one of said back cover and said front cover such that each one of said plurality of bolts extends through a respective one of said plurality of lobes of said housing.

23. A camshaft phaser as in claim 21 wherein said gear drive unit is disposed within a front cover bore of said front cover.

* * * * *